US005219490A

United States Patent [19]

Basu et al.

[11] Patent Number: 5,219,490

[45] Date of Patent: Jun. 15, 1993

[54] AZEOTROPE-LIKE COMPOSITIONS OF 1,1,2,3,3-PENTAFLUOROPROPANE

[75] Inventors: Rajat S. Basu, Williamsville; Peter B. Logsdon, North Tonawanda; Leonard M. Stachura, Hamburg; Earl A. E. Lund, West Seneca, all of N.Y.

[73] Assignee: Allied-Signal Inc., Morristown, N.J.

[21] Appl. No.: 873,861

[22] Filed: Apr. 27, 1992

[51] Int. Cl.[5] ..... C11D 7/30; C11D 7/50; C23G 5/028; D06L 1/02

[52] U.S. Cl. ..... 252/171; 8/142; 134/12; 134/31; 134/38; 134/40; 134/42; 252/153; 252/162; 252/170; 252/364; 252/DIG. 9

[58] Field of Search ..... 8/142; 134/38, 40, 42, 134/12, 31; 252/162, 153, 170, 171, DIG. 9, 364, 67

[56] References Cited

U.S. PATENT DOCUMENTS

| | | | |
|---|---|---|---|
| 3,369,913 | 2/1968 | Livengood | 252/305 |
| 3,536,627 | 10/1970 | Snider | 252/67 |
| 4,451,943 | 6/1984 | Powell | 252/67 |
| 4,454,983 | 6/1984 | Tarves | 165/40 |
| 4,910,041 | 3/1990 | Yanagihara | 427/571 |
| 5,023,010 | 6/1991 | Merchant . | |
| 5,035,830 | 7/1991 | Merchant . | |
| 5,064,559 | 11/1991 | Merchant et al. . | |
| 5,073,288 | 12/1991 | Anton . | |
| 5,073,290 | 12/1991 | Anton et al. . | |
| 5,073,291 | 12/1991 | Robeck et al. . | |
| 5,084,190 | 1/1992 | Fernandez | 252/8 |

FOREIGN PATENT DOCUMENTS

| | | | |
|---|---|---|---|
| 2009169 | 8/1990 | Canada . | |
| 431458 | 6/1991 | European Pat. Off. . | |
| 2-272086 | 11/1990 | Japan | 252/67 |

*Primary Examiner*—Linda Skaling
*Attorney, Agent, or Firm*—Melanie L. Brown; Jay P. Friedenson; Darryl L. Webster

[57] ABSTRACT

Azeotrope like compositions comprising 1,1,2,3,3,-pentafluoropropane and methanol or ethanol and optionally nitromethane are stable and have utility as degreasing agents and as solvents in a variety of industrial cleaning applications including cold cleaning and defluxing of printed circuit boards and dry cleaning.

18 Claims, No Drawings

AZEOTROPE-LIKE COMPOSITIONS OF 1,1,2,3,3-PENTAFLUOROPROPANE

BACKGROUND OF THE INVENTION

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Cold cleaning is another application where a number of solvents are used. In most cold cleaning applications, the soiled part is either immersed in the fluid or wiped with rags or similar objects soaked in solvents and allowed to air dry.

Fluorocarbon solvents, such as trichlorotrifluoroethane, have attained widespread use in recent years as effective, nontoxic, and nonflammable agents useful in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like.

Azeotropic or azeotrope-like compositions are desired because they do not fractionate upon boiling. This behavior is desirable because in the previously described vapor degreasing equipment with which these solvents are employed, redistilled material is generated for final rinse.cleaning. Thus, the vapor degreasing system acts as a still. Unless the solvent composition exhibits a constant boiling point, i.e., is azeotrope-like, fractionation will occur and undesirable solvent distribution may act to upset the cleaning and safety of processing. Preferential evaporation of the more volatile components of the solvent mixtures, which would be the case if they were not azeotrope-like, would result in mixtures with changed compositions which may have less desirable properties, such as lower solvency towards soils, less inertness towards metal, plastic or elastomer components, and increased flammability and toxicity. The art has looked towards azeotrope or azeotrope-like compositions including the desired fluorocarbon components such as trichlorotrifluoroethane which include components which contribute additionally desired characteristics, such as polar functionality, increased solvency power, and stabilizers.

The art is continually seeking new fluorocarbon, hydrofluorocarbon, and hydrochlorofluorocarbon based azeotrope-like mixtures which offer alternatives for new and special applications for vapor degreasing and other cleaning applications. Currently, of particular interest, are fluorocarbon, hydrofluorocarbon, and hydrochlorofluorocarbon based azeotrope-like mixtures with minimal or no chlorine which are considered to be stratospherically safe substitutes for presently used chlorofluorocarbons (CFCs). The latter are suspected of causing environmental problems in connection with the earth's protective ozone layer. Mathematical models have substantiated that hydrofluorocarbons, such as 1,1,2,3,3.pentafluoropropane (known in the art as HFC-245ea), will not adversely affect atmospheric chemistry, being negligible contributors to ozone depletion and to green house global warming in comparison to chlorofluorocarbons such as 1,1,2-trichloro-1,2,2-trifluoroethane (CFC-113).

European Publication 431,458 published Jun. 12, 1991 teaches a mixture of 1,1,2,3,4,4-hexafluorobutane and ethanol. U.S. Pat. No. 5,023,010 teaches an azeotropic mixture of 1,1,1,2,3,3-hexafluoro-3-methoxypropane and methanol. U.S. Pat. No. 5,035,830 teaches an azeotropic mixture of hexafluoropropylene/ethylene cyclic dimer and methanol or ethanol. U.S. Pat. No. 5,064,559 teaches an azeotropic mixture of 1,1,1,2,3,4,4,5,5,5-decafluoropentane and methanol or ethanol. U.S. Pat. No. 5,073,291 teaches an azeotrope-type mixture of 1,4-dihydroperfluorobutane and methanol.

U.S. Pat. Nos. 5,073,288 and 5,073,290 teach binary azeotrope-like compositions of 1,1,1,2,2,3,5,5,5-nonafluoro-4-trifluoromethylpentane or 1,1,1,2,2,5,5,5-octafluoro-4-trifluoromethylpentane and methanol or ethanol.

DETAILED DESCRIPTION OF THE INVENTION

Our solution to the need in the art for substitutes for chlorofluorocarbon solvents is mixtures comprising 1,1,2,3,3-pentafluoropropane and methanol or ethanol and optionally nitromethane. Also, novel azeotrope-like or constant.boiling compositions have been discovered comprising 1,1,2,3,3-pentafluoropropane and methanol or ethanol and optionally nitromethane.

Preferably, the novel azeotrope-like compositions comprise effective amounts of 1,1,2,3,3-pentafluoropropane and methanol or ethanol and optionally nitromethane. The term "effective amounts" as used herein means the amount of each component which upon combination with the other component, results in the formation of the present azeotrope-like compositions.

The azeotrope-like compositions comprise from about 89 to about 99.99 weight percent of 1,1,2,3,3-pentafluoropropane and from about 0.01 to about 11 of methanol or ethanol and from 0 to about 1 weight percent nitromethane.

The present azeotrope-like compositions are advantageous for the following reasons. The 1,1,2,3,3-pentafluoropropane is a negligible contributor to ozone depletion and has a boiling point of 40° C. The methanol and ethanol components have good solvent properties. Thus, when these components are combined in effective amounts, an efficient azeotrope-like solvent results.

The preferred azeotrope-like compositions are in the Table below where 1,1,2,3,3-pentafluoropropane is abbreviated as HFC-245ea. In the Table, the numerical ranges are understood to be prefaced by "about".

| COMPONENTS | PREFERRED RANGE (WT. %) | MORE PREFERRED RANGE (WT. %) | MOST PREFERRED RANGE (WT. %) | BOILING POINT (°C.) (760 mmHg) |
|---|---|---|---|---|
| HFC-245ea | 89-99.5 | 90-98.2 | 90.6-97.6 | 38.1 ± 0.4 |
| Methanol | 0.5-11 | 1.8-10 | 2.4-9.2 | |
| Nitromethane | 0-1 | 0-0.5 | 0-0.4 | |
| HFC-245ea | 97-99.99 | 98.5-99.99 | 98.8-99.99 | 38.5 ± 0.2 |
| Ethanol | 0.01-3 | 0.01-1.5 | 0.01-1.2 | |
| Nitromethane | 0-1 | 0-0.5 | 0-0.4 | |

All compositions within the indicated ranges, as well as certain compositions outside the indicated ranges, are azeotrope-like, as defined more particularly below.

The precise azeotrope compositions have not been determined but have been ascertained to be within the above ranges. Regardless of where the true azeotropes lie, all compositions with the indicated ranges, as well as certain compositions outside the indicated ranges, are azeotrope like, as defined more particularly below.

The term "azeotrope-like composition" as used herein is intended to mean that the composition behaves like an azeotrope, i.e. has constant-boiling characteristics or a tendency not to fractionate upon boiling or evaporation. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is to be contrasted with non-azeotrope-like compositions in which during boiling or evaporation, the liquid composition changes to a substantial degree. As is readily understood by persons skilled in the art, the boiling point of the azeotrope-like composition will vary with the pressure.

The azeotrope-like compositions of the invention are useful as solvents in a variety of vapor degreasing, cold cleaning and solvent cleaning applications including defluxing and dry cleaning.

In the process embodiment of the invention, the azeotrope-like compositions of the invention may be used to clean solid surfaces by treating said surfaces with said compositions in any manner well known to the art such as by dipping or spraying or use of conventional degreasing apparatus. In one process embodiment of the invention, the azeotrope-like compositions of the invention may be used to dissolve contaminants or remove contaminants from the surface of a substrate by treating the surfaces with the compositions in any manner well known to the art such as by dipping or spraying or use of conventional degreasing apparatus wherein the contaminants are substantially removed or dissolved.

The 1,1,2,3,3-pentafluoropropane of the present invention may be prepared by any known method such as the reaction of commercially available tetrahydrofuran and cobalt trifluoride as taught by J. Burdon et al., "Partial Fluorination of Tetrahydrofuran with Cobalt Trifluoride", *J. of Chem. Soc.* (*C*), 1739 (1969). The methanol: ethanol: and nitromethane components of the novel solvent azeotrope-like compositions of the invention are known materials and are commercially available.

EXAMPLE 1

This example shows that a minimum in the boiling point versus composition curve occurs in the region of 95 weight percent 1,1,2,3,3-pentafluoropropane (hereinafter HFC-245ea) and 5 weight percent methanol indicating that an azeotrope forms in the neighborhood of this composition.

A microebulliometer which consisted of a 15 milliliter round bottom double neck flask containing a magnetic stirbar and heated with an electrical heating mantel was used. Approximately 2.5 milliliters of the lower boiling material, HFC-245ea, was charged into the microebulliometer and methanol was added in small measured increments by an automated syringe capable of injecting microliters. The temperature was measured using a platinum resistance thermometer and barometric pressure was measured. An approximate correction to the boiling point was done to obtain the boiling point at 760 mm Hg.

The boiling point was measured and corrected to 760 mm Hg (101 kPa) for various mixtures of HFC-245ea and methanol. Interpolation of the data shows that a minimum boiling point occurs in the region of about 2.4 to about 9 weight percent methanol. The best estimate of the position of the minimum is 4.7 weight percent methanol, although the mixtures are constant-boiling, to within 0.4° C., in the region of 0.5 to 10 weight percent methanol. A minimum boiling azeotrope is thus shown to exist in this composition range.

No attempt was made to fully characterize and define the outer limits of the composition ranges which are constant boiling. Anyone skilled in the art can readily ascertain other constant boiling or essentially constant boiling mixtures containing the same components.

EXAMPLE 2

Example 1 was repeated except that ethanol was used instead of methanol. Approximately 2.8 milliliters of the lower boiling material, HFC-245ea, were initially charged into the microebulliometer and ethanol was added in small measured increments by an automated syringe capable of injecting microliters. The boiling point was measured and corrected to 760 mm Hg (101 kPa), for various mixtures of HFC-245ea and ethanol. Interpolation of these data shows that a minimum boiling point occurs in the region of about 0.1 to about 0.8 weight percent ethanol. The best estimate of the position of the minimum is 0.5 weight percent ethanol, although the mixtures are constant.boiling, to within 0.2° C., in the region of 0.01 to 2 weight percent ethanol. A minimum boiling azeotrope is thus shown to exist in this composition range.

EXAMPLES 3 AND 4

Performance studies are conducted wherein metal coupons are cleaned using the present azeotrope-like compositions as solvents. The metal coupons are soiled with various types of oils and heated to 93° C. so as to partially simulate the temperature attained while machining and grinding in the presence of these oils.

The metal coupons thus treated are degreased in a three-sump vapor phase degreaser machine. In this typical three-sump degreaser, condenser coils around the lip of the machine are used to condense the solvent vapor which is then collected in a sump. The condensate overflows into cascading sumps and eventually goes into the boiling sump.

The metal coupons are held in the solvent vapor and then vapor rinsed for a period of 15 seconds to 2 minutes depending upon the oils selected. The azeotrope-like compositions of Examples 1 and 2 are used as the solvents. Cleanliness testing of the coupons is done by measurement of the weight change of the coupons using an analytical balance to determine the total residual materials left after cleaning.

EXAMPLES 5 AND 6

Each solvent of Examples 1 and 2 above is added to mineral oil in a weight ratio of 50:50 at 27° C. Each solvent is miscible in the mineral oil.

EXAMPLES 7 AND 8

Metal coupons are soiled with various types of oil. The soiled metal coupons are immersed in the solvents of Examples 1 and 2 above for a period of 15 seconds to 2 minutes, removed, and allowed to air dry. Upon visual inspection, the soil appears to be substantially removed.

EXAMPLES 9 AND 10

Metal coupons are soiled with various types of oil. The soiled metal coupons are sprayed with the solvents of Examples 1 and 2 above and allowed to air dry. Upon visual inspection, the soil appears to be substantially removed.

Known additives may be used with the present azeotrope-like compositions in order to tailor the composition for a particular use. Inhibitors may be added to the present azeotrope-like compositions to inhibit decomposition of the compositions; react with undesirable decomposition products of the compositions; and/or prevent corrosion of metal surfaces. Any or all of the following classes of inhibitors may be employed in the invention: alkanols having 4 to 7 carbon atoms, nitroalkanes having 2 to 3 carbon atoms, 1,2-epoxyalkanes having 2 to 7 carbon atoms, phosphite esters having 12 to 30 carbon atoms, ethers having 3 or 4 carbon atoms, unsaturated compounds having 4 to 6 carbon atoms, acetals having 4 to 7 carbon atoms, ketones having 3 to 5 carbon atoms, and amines having 6 to 8 carbon atoms. Other suitable inhibitors will readily occur to those skilled in the art. In spraying applications, the azeotrope-like compositions may be sprayed onto a surface by using a propellant.

The inhibitors may be used alone or in mixtures thereof in any proportions. Typically, up to about 2 percent based on the total weight of the azeotrope-like composition of inhibitor might be used.

What is claimed is:

1. Azeotrope--like compositions consisting essentially of from about 89 to about 99.5 weight percent of 1,1,2,3,3,-pentafluoropropane and from about 0.5 to about 11 weight percent of methanol and from about 0 to about 1 weight percent nitromethane wherein said compositions boil at about 38.1° C. at 760 mm Hg.

2. The azeotrope-like compositions of claim 1 consisting essentially of from about 90 to about 98.2 weight percent said 1,1,2,3,3-pentafluoropropane and from about 1.8 to about 10 weight percent said methanol and from about 0 to about 0.5 weight percent said nitromethane wherein said compositions boil at about 38.1° C. at 760 mm Hg.

3. The azeotrope-like compositions of claim 1 consisting essentially of from about 90.6 to about 97.6 weight percent said 1,1,2,3,3-pentafluoropropane and from about 2.4 to about 9.4 weight percent said methanol and from about 0 to about 0.4 weight percent said nitromethane wherein said compositions boil at about 38.1° C. at 760 mm Hg.

4. Azeotrope-like compositions consisting essentially of from about 97 to about 99.99 weight percent of 1,1,2,3,3-pentafluoropropane and from about 0.01 to about 3 weight percent of ethanol and from about 0 to about 1 weight percent nitromethane wherein said compositions boil at about 8.5° C. at 760 mm Hg.

5. The azeotrope-like compositions of claim 4 consisting essentially of from about 98.5 to about 9.99 weight percent said 1,1,2,3,3-pentafluoropropane and from about 0.01 to about 1.5 weight percent said ethanol and from about 0 to about 0.5 weight percent said nitromethane wherein said compositions boil at about 38.5° C. at 760 mm Hg.

6. The azeotrope-like compositions of claim 4 consisting essentially of from about 98.8 to about 99.99 weight percent said 1,1,2,3,3-pentafluoropropane and from about 0.01 to about 1.2 weight percent said ethanol and from about 0 to about 0.4 weight percent said nitromethane wherein said compositions boil at about 38.5° C. at 760 mm Hg.

7. The azeotrope-like compositions of claim 1 wherein an effective amount of an inhibitor is present in said compositions to accomplish at least one of the following: inhibit decomposition of the compositions, react with undesirable decomposition products of the compositions, and prevent corrosion of metal surfaces.

8. The azeotrope-like composition of claim 7 wherein said inhibitor is selected from the group consisting of alkanols having 4 to 7 carbon atoms, nitroalkanes having 2 to 3 carbon atoms, phosphite esters having 12 to 30 carbon atoms, ethers having 3 or 4 carbon atoms, acetals having 4 to 7 carbon atoms, ketones having 3 to 5 carbon atoms, and amines having 6 to 8 carbon atoms.

9. The azeotrope-like compositions of claim 7 wherein said inhibitor is selected from the group consisting of 1,2-expoyalkanes having 2 to 7 carbon atoms.

10. The azeotrope-like compositions of claim 4 wherein an effective amount of an inhibitor is present in said compositions to accomplish at least one of the following: inhibit decomposition of the compositions, react with undesirable decomposition products of the compositions, and prevent corrosion of metal surfaces.

11. The azeotrope-like composition of claim 10 wherein said inhibitor is selected from the group consisting of alkanols having 4 to 7 carbon atoms, nitroalkanes having 2 to 3 carbon atoms, phosphite esters having 12 to 30 carbon atoms, ethers having 3 to 4 carbon atoms, acetals having 4 to 7 carbon atoms, ketones having 3 to 5 carbon atoms, and amines having 6 to 8 carbon atoms.

12. The azeotrope-like compositions of claim 10 wherein said inhibitor is selected from the group consisting of 1,2-epoxyalkanes having 2 to 7 carbon atoms.

13. A method of dissolving contaminants or removing contaminants from the surface of a substrate which comprise the step of:

treating said surface of substrate with said azeotrope-like composition of claim 1 as solvent.

14. A method of dissolving contaminants or removing contaminants from the surface of a substrate which comprises the step of:

treating said surface of said substrate with said azeotrope-like composition of claim 2 as solvent.

15. A method of dissolving contaminants or removing contaminants from the surface of a substrate which comprises the step of:

treating said surface of said substrate with said azeotrope-like composition of claim 3 as solvent.

16. A method of dissovling contaminants or removing contaminants form the surface of a substrate which comprises the step of:

treating said surface of said substrate with said azeotrope-like composition of claim 4 as solvent.

17. A method of dissolving contaminants or removing contaminants from the surface of a substrate which comprises the step of:

treating said surface of said substrate with said azeotrope-like composition of claim 5 as solvent.

18. A method of dissolving contaminants or removing contaminants from the surface of a substrate which comprises the step of:

treating said surface of said substrate with said azeotrope-like composition of claim 6 as solvent.

* * * * *